US007828230B1

(12) United States Patent
Anuskiewicz et al.

(10) Patent No.: US 7,828,230 B1
(45) **Date of Patent: *Nov. 9, 2010**

(54) AXIALLY DISPLACING SLIP-CLUTCH FOR ROTOR-TYPE SPRINKLER

(75) Inventors: Ronald H. Anuskiewicz, San Diego, CA (US); Kyle R. Capen, Temecula, CA (US)

(73) Assignee: Hunter Industries, Inc., San Marcos, CA (US)

( * ) Notice: Subject to any disclaimer, the term of this patent is extended or adjusted under 35 U.S.C. 154(b) by 67 days.

This patent is subject to a terminal disclaimer.

(21) Appl. No.: 11/846,480

(22) Filed: Aug. 28, 2007

Related U.S. Application Data

(63) Continuation-in-part of application No. 11/558,287, filed on Nov. 9, 2006, now abandoned, which is a continuation of application No. 11/465,368, filed on Aug. 17, 2006, now abandoned.

(51) Int. Cl.
*B05B 3/04* (2006.01)

(52) U.S. Cl. ..... 239/263; 239/263.3; 239/240; 239/237; 239/203; 239/204

(58) Field of Classification Search ..... 239/203, 239/204, 205, 263.3, 240, 238, 283, 206, 239/207, 237, 390, 391, 263
See application file for complete search history.

(56) References Cited

U.S. PATENT DOCUMENTS

| | | | | |
|---|---|---|---|---|
| 3,107,056 | A * | 10/1963 | Hunter | 239/206 |
| 3,383,047 | A * | 5/1968 | Hauser | 239/206 |
| 3,934,820 | A * | 1/1976 | Phaup | 239/205 |
| 4,568,024 | A | 2/1986 | Hunter | 239/242 |
| 4,625,914 | A | 12/1986 | Secton et al. | 239/206 |
| 4,718,605 | A | 1/1988 | Hunter | 239/242 |
| 4,892,252 | A | 1/1990 | Bruniga | 239/205 |
| 4,901,924 | A | 2/1990 | Kah, Jr. | 239/242 |
| 5,048,757 | A * | 9/1991 | Van Leeuwen | 239/205 |
| 5,052,621 | A * | 10/1991 | Katzer et al. | 239/242 |
| 5,148,991 | A | 9/1992 | Kah, Jr. | 239/242 |
| 5,383,600 | A * | 1/1995 | Verbera et al. | 239/205 |
| 5,673,855 | A | 10/1997 | Nguyen et al. | 239/241 |
| 5,676,315 | A | 10/1997 | Han | 239/590 |
| 5,695,123 | A | 12/1997 | Le | 239/259 |
| 5,758,827 | A | 6/1998 | Van Le et al. | 239/242 |
| 6,042,021 | A | 3/2000 | Clark | 239/205 |
| 6,050,502 | A | 4/2000 | Clark | 239/237 |
| 6,732,950 | B2 | 5/2004 | Ingham, Jr. et al. | 239/205 |
| 6,840,460 | B2 | 1/2005 | Clark | 239/205 |
| 6,945,471 | B2 * | 9/2005 | McKenzie et al. | 239/237 |
| 7,017,837 | B2 * | 3/2006 | Taketomi et al. | 239/428.5 |
| 7,040,553 | B2 | 5/2006 | Clark | |
| 7,261,247 | B2 * | 8/2007 | Yeh et al. | 239/237 |
| 7,530,504 | B1 * | 5/2009 | Danner et al. | 239/240 |
| 2006/0049275 | A1 | 3/2006 | Santiago et al. | 239/240 |
| 2006/0108446 | A1 * | 5/2006 | Yeh et al. | 239/240 |

* cited by examiner

*Primary Examiner*—Len Tran
*Assistant Examiner*—Trevor E McGraw
(74) *Attorney, Agent, or Firm*—Michael H. Jester

(57) ABSTRACT

A sprinkler includes a riser, an impeller mounted in the riser, and a nozzle rotatably mounted at an upper end of the riser. A drive assembly including a reduction gear train couples the impeller and the nozzle. A clutch in the drive assembly includes a clutch member having an axis of rotation that provides a positive drive connection under a normal load and axially displaces and slips under an excessive load.

12 Claims, 15 Drawing Sheets

AXIALLY DISPLACING SLIP-CLUTCH FOR ROTOR-TYPE SPRINKLER

CROSS-REFERENCE TO RELATED APPLICATIONS

This application is a continuation-in-part of pending U.S. patent application Ser. No. 11/558,287 filed Nov. 9, 2006, which was a continuation of now-abandoned U.S. patent application Ser. No. 11/465,368 filed Aug. 17, 2006. The subject application claims priority from the filing dates of both of said applications under 35 U.S.C. Sections 119 and 120.

FIELD OF THE INVENTION

The present invention relates to sprinklers used to irrigate turf and landscaping, and more particularly, to clutch mechanisms designed to prevent drive assembly damage when vandals twist the nozzle turret of a rotor-type sprinkler.

BACKGROUND OF THE INVENTION

A common type of irrigation sprinkler used to water turf and landscaping is referred to as a rotor-type sprinkler. It typically includes a riser that telescopes from an outer casing. The riser encloses a turbine that rotates a nozzle turret at the top of the riser through a reduction gear train and reversing mechanism. Typically the nozzle turret oscillates back and forth through an arc whose size can be adjusted depending on the area of coverage required. Vandals frequently twist the nozzle turret of rotor-type sprinklers which causes them to spray water outside their intended arc of coverage, often onto roads and sidewalks. When a vandal twists the nozzle turret of a rotor-type sprinkler to "back drive" the sprinkler, i.e. rotate the nozzle turret in a direction opposite the direction it is currently being driven by its turbine, strong rotational forces are transmitted to the reversing mechanism and reduction gear train, frequently damaging the same.

Rotor-type sprinklers often include some form of clutch that slips when the nozzle turret is rotated by an external force, i.e. one not generated by the turbine. A clutch in a rotor-type sprinkler must be able to transmit a steady rotational drive force to the nozzle turret so that the turbine can rotate the nozzle turret back and forth between the pre-set arc limits, or in some cases, rotate the nozzle turret continuously through three hundred and sixty degrees. However the clutch must be capable of breaking loose or disengaging when the nozzle turret is twisted by a vandal.

Rotor-type sprinklers have also been developed that include an automatic arc return mechanism so that the nozzle turret can be twisted out of arc by a vandal, and will resume oscillation within the intended arc of coverage without any resulting damage to the reduction gear train or reversing mechanism. See for example U.S. Pat. No. 6,050,502 granted to Clark on Apr. 18, 2000 and U.S. Pat. No. 6,840,460 granted to Clark on Jan. 11, 2005, both assigned to Hunter Industries, Inc., the assignee of the subject application.

Clutches and automatic arc return mechanisms that have heretofore been developed for rotor-type sprinklers have been too complex, required too many parts and/or been too unreliable. They have also not been suitable for retrofitting, i.e. installation into existing rotor-type sprinklers not originally designed with clutches to prevent back driving.

SUMMARY OF THE INVENTION

In accordance with the invention, a sprinkler includes a riser, an impeller mounted in the riser, and a nozzle rotatably mounted at an upper end of the riser. A drive assembly including a reduction gear train couples the impeller and the nozzle. A clutch in the drive assembly includes a clutch member having an axis of rotation that provides a positive drive connection under a normal load and axially displaces and slips under an excessive load.

DETAILED DESCRIPTION

The entire disclosures of U.S. Pat. No. 3,107,056 granted to Hunter on Oct. 15, 1963; U.S. Pat. No. 4,568,024 granted to Hunter on Feb. 4, 1986; U.S. Pat. No. 4,718,605 granted to Hunter on Jan. 12, 1988; U.S. Pat. No. 6,050,502 granted to Clark on Apr. 18, 2000; U.S. Pat. No. 6,840,460 granted to Clark on Jan. 11, 2005; and pending U.S. patent application Ser. No. 11/139,725 filed by Crooks on May 27, 2005, are hereby incorporated by reference.

Figure 1:
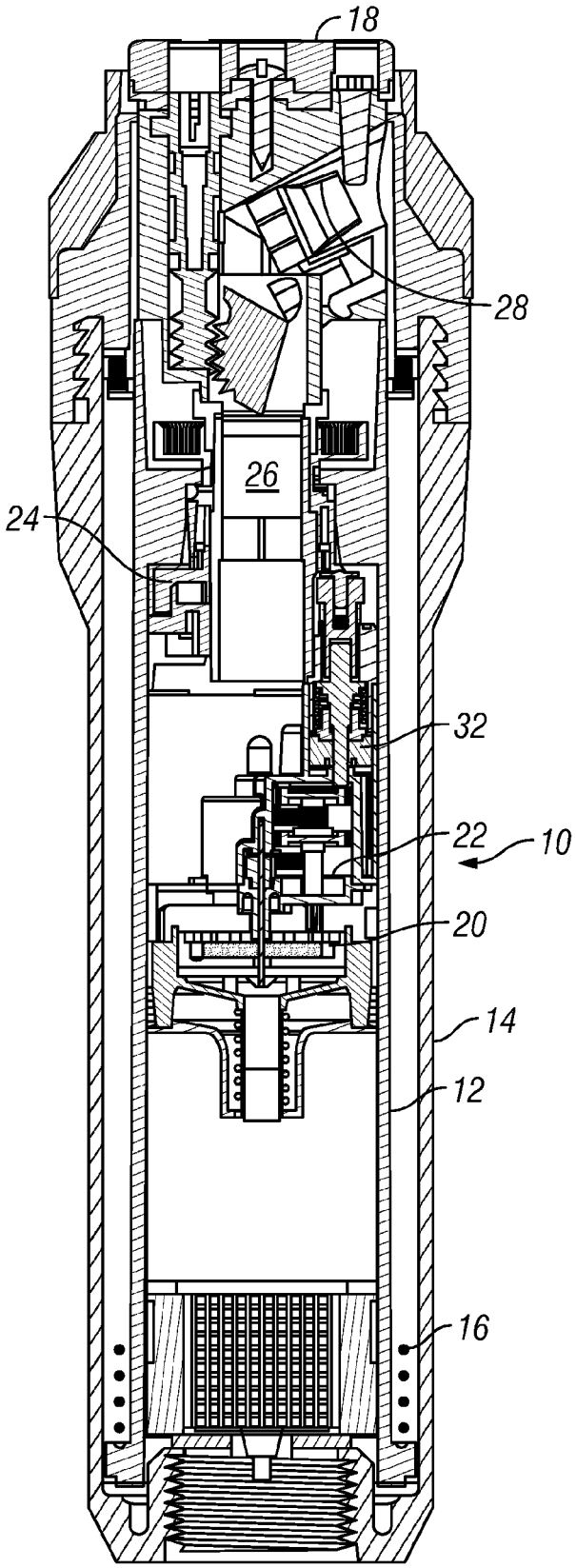
FIG. 1 is a vertical sectional view of a rotor-type sprinkler in accordance with an embodiment of the invention.

Referring to FIG. 1, in accordance with an embodiment of the invention, a rotor-type sprinkler 10 includes a tubular riser 12 vertically reciprocable within an outer case 14 and normally held in a retracted position by a relatively large stainless steel coil spring illustrated diagrammatically by dots 16. A cylindrical nozzle head or turret 18 is rotatably mounted at the upper end of the riser 12. A turbine 20, reduction gear train 22, and a reversing mechanism 24 are mounted in the riser 12 and rotate the nozzle turret 18 through an adjustable arc, as well known in the art. Besides the turbine 20, other impellers may be used, such as ball drives, swirl plates, and so forth. See for example U.S. Pat. No. 4,625,914 granted to Sexton et al. on Dec. 2, 1986.

Figure 8:
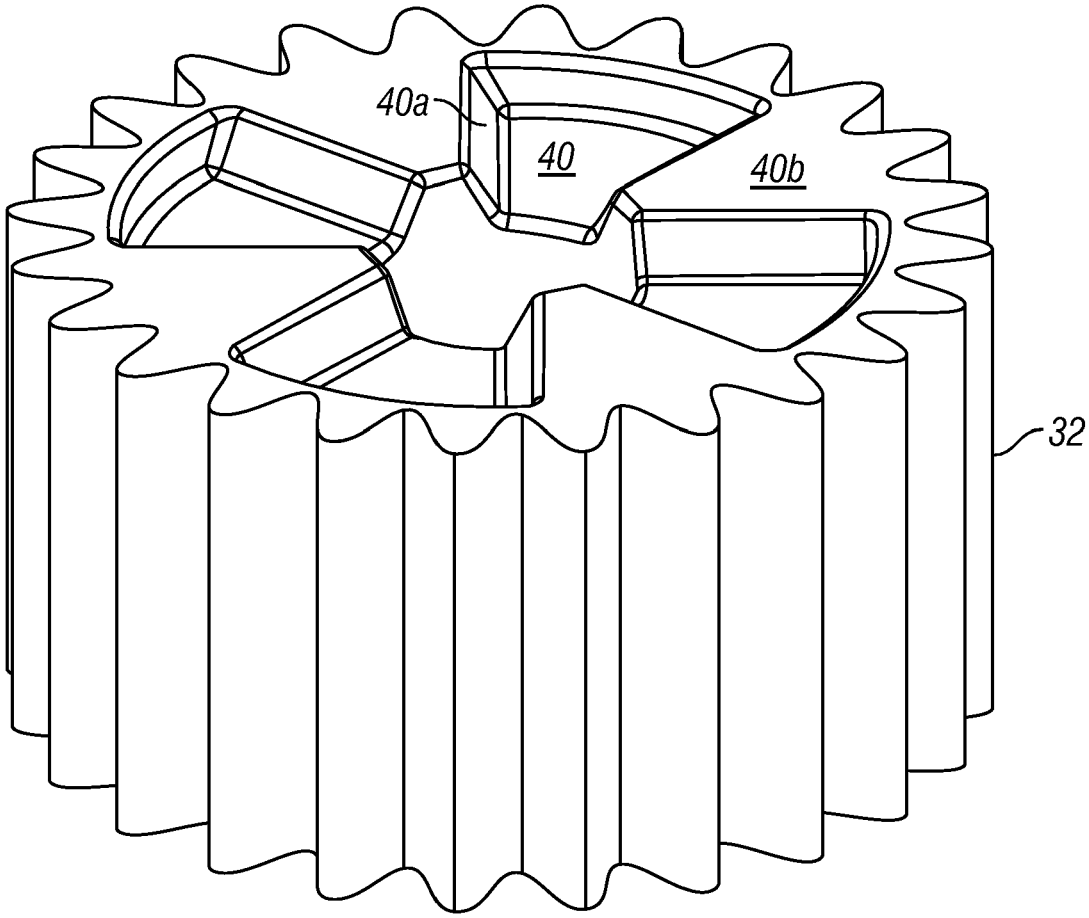
FIG. 8 is a greatly enlarged isometric view illustrating the recesses in the upper side of the final output gear of the sprinkler of FIG. 1.
Figure 9:
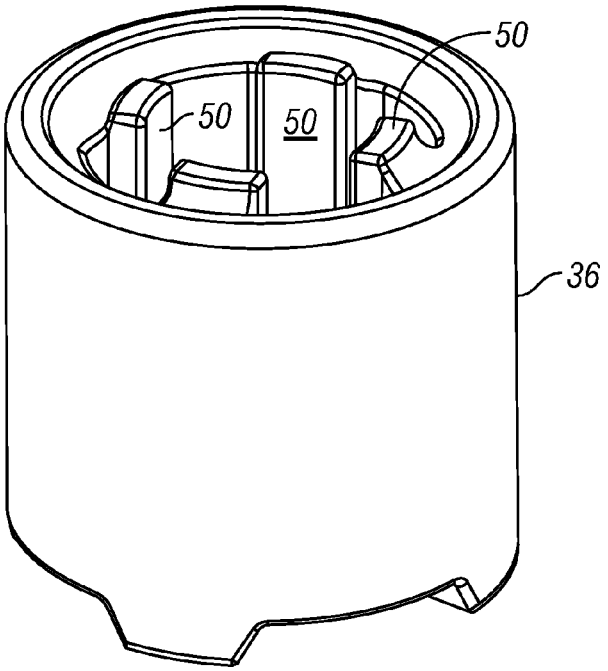
FIG. 9 is a greatly enlarged isometric view from the top of the clutch member of the sprinkler of FIG. 1 illustrating the ribs of its central bore.
Figure 10:
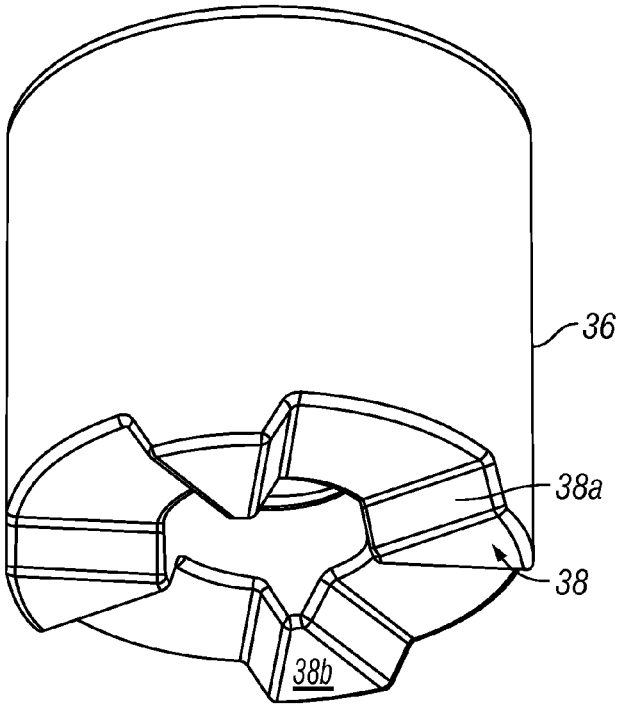
FIG. 10 is a greatly enlarged isometric view illustrating the projections on the underside of the clutch member that mate with the complementary recesses in the upper side of the final output gear illustrated in FIG. 8.

Together, the reduction gear train 22 and reversing mechanism 24 form a drive assembly coupling the turbine 20 and the nozzle turret 18 via a relatively large hollow tubular shaft 26. Water flows through the turbine 20, through the shaft 26 and exits through a replaceable nozzle 28 mounted in the nozzle turret 18. The nozzle 28 of the illustrated embodiment is removably mounted in snap-in fashion in a socket in the nozzle turret 18. Alternatively, the nozzle 28 can be a permanent fixture not requiring any turret for support. In such a case the drive assembly still couples the turbine 20 and the nozzle 28. In the embodiment illustrated, the drive assembly couples the turbine 20 and the nozzle 28 though the shaft 26 and the nozzle turret 18. A slip-clutch 30 (FIG. 2), described hereafter in detail, is also included in the drive assembly between a final output gear 32 (FIGS. 2 and 8) of the reduction gear train 22 and an input gear 34 (FIG. 3) of the reversing mechanism 24. The slip-clutch 30 includes a clutch member 36 (FIGS. 2, 9 and 10) that provides a positive drive connection under a normal load and axially displaces and slips under an excessive externally applied load such as that which occurs when a vandal twists the nozzle turret 18.

Figure 2:
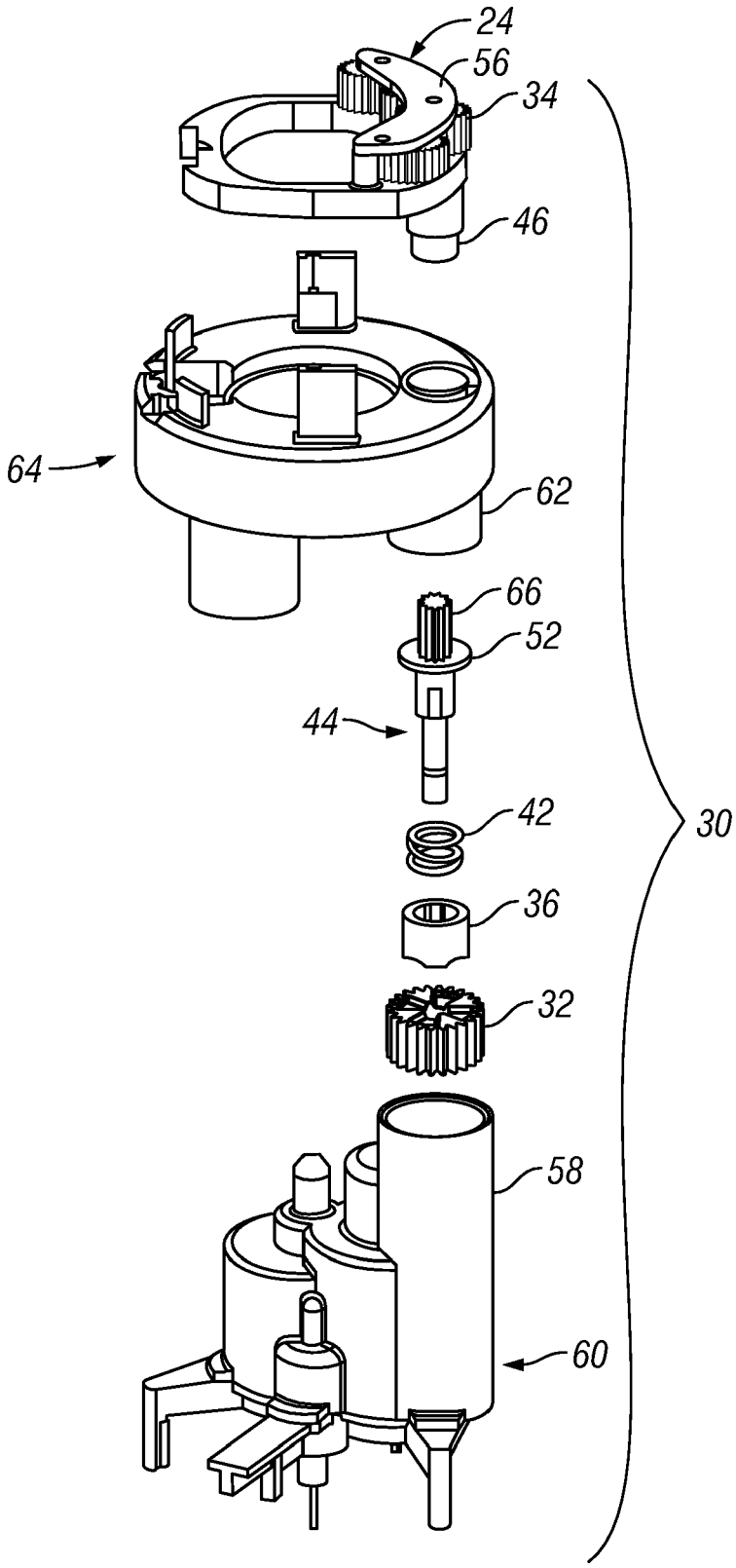
FIG. 2 is an enlarged exploded isometric view of portions of the rotor-type sprinkler of FIG. 1 illustrating the location and components of its axially displacing slip-clutch.
Figure 11:
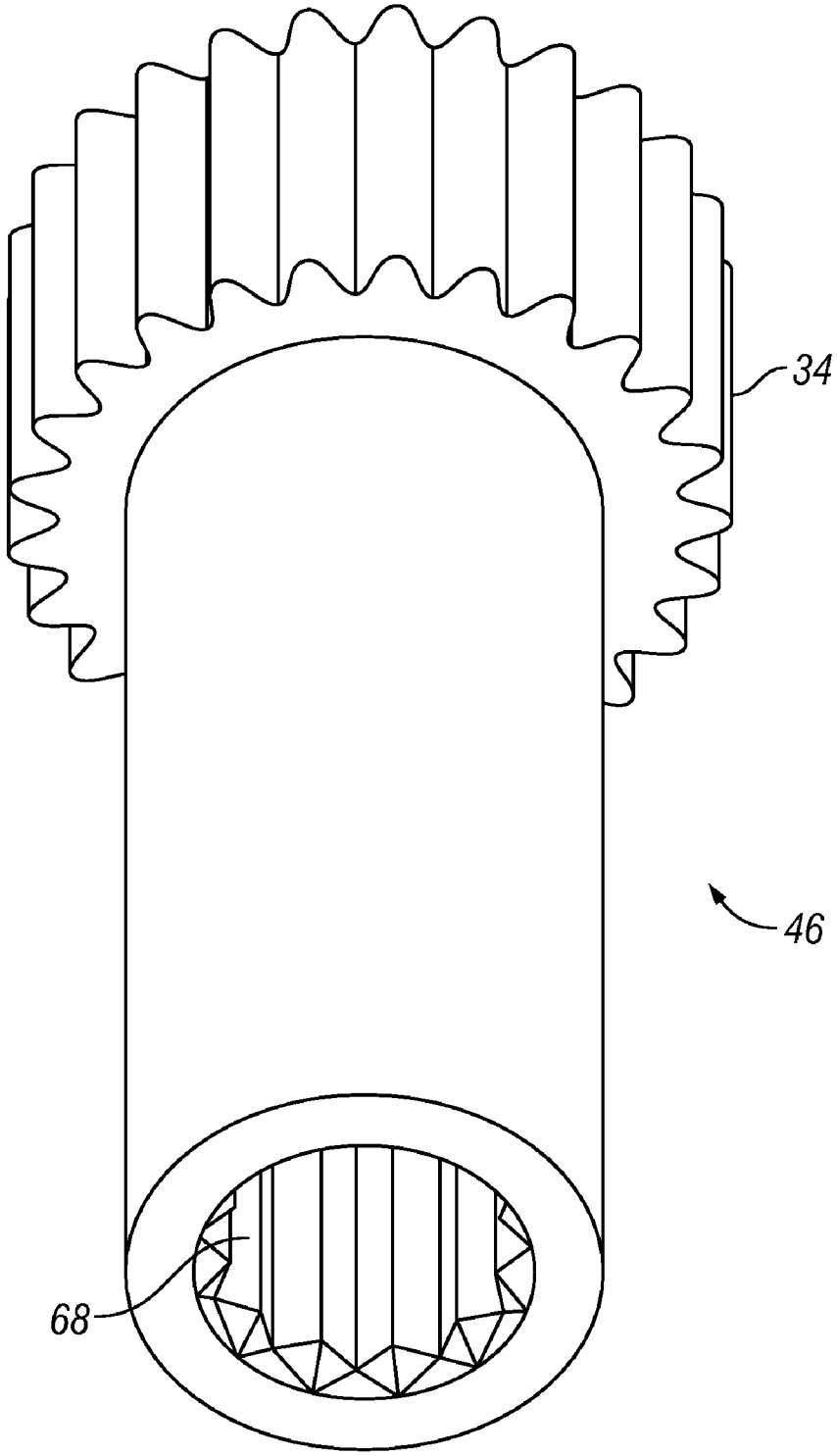
FIG. 11 is a greatly enlarged isometric view of the upper output shaft of the axially displacing slip-clutch illustrating the ribs of its central bore.
Figure 12:
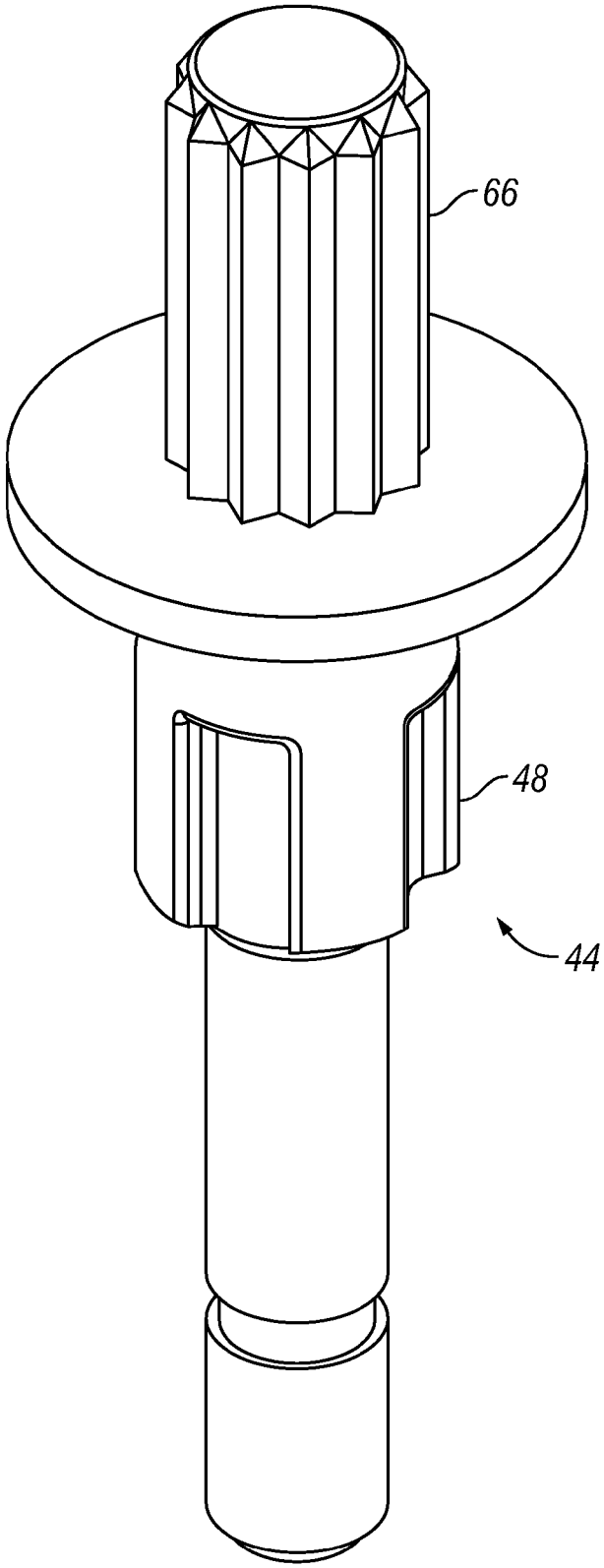
FIG. 12 is a greatly enlarged isometric view of the lower output shaft of the axially displacing slip-clutch.

The lower side of the clutch member 36 directly engages the upper side of the output gear 32 of the reduction gear train 22. The clutch member 36 and the output gear 32 have complementary pie-shaped projections 38 (FIG. 10) and recesses 40 (FIG. 8), respectively. A relatively small stainless steel coil spring 42 (FIG. 2) urges the clutch member 36 against the output gear 32. The slip-clutch 30 further includes a drive shaft comprising a lower output shaft 44 (FIGS. 2 and 12) and an upper output shaft 46 (FIGS. 2 and 11). The lower output shaft 44 has a lower end coupled to the clutch member 36. The upper output shaft 46 has an upper end coupled to the reversing mechanism 24. The lower end of the lower output shaft 46 is splined to the clutch member 36 via four ribs 48 (FIG. 12) formed on the exterior of the lower output shaft 44. The ribs 48 mate with four complementary ribs 50 (FIG. 9) formed in a central bore of the clutch member 36. The coil spring 42 (FIG. 2) is compressed between the clutch member 36 and a radially extending flange or shoulder 52 of the lower output shaft 44. The upper end of the upper output shaft 46 is formed as the input gear 34 which is coupled to the reversing mechanism 24 of the drive assembly. The input gear 34 is one of four identical spur gears of the reversing mechanism 24 visible in FIG. 3. These spur gears are carried on crescent-shaped upper and lower frames 54 and 56 that rock back and forth with the aid of Omega over-center springs (not illustrated).

Figure 3:
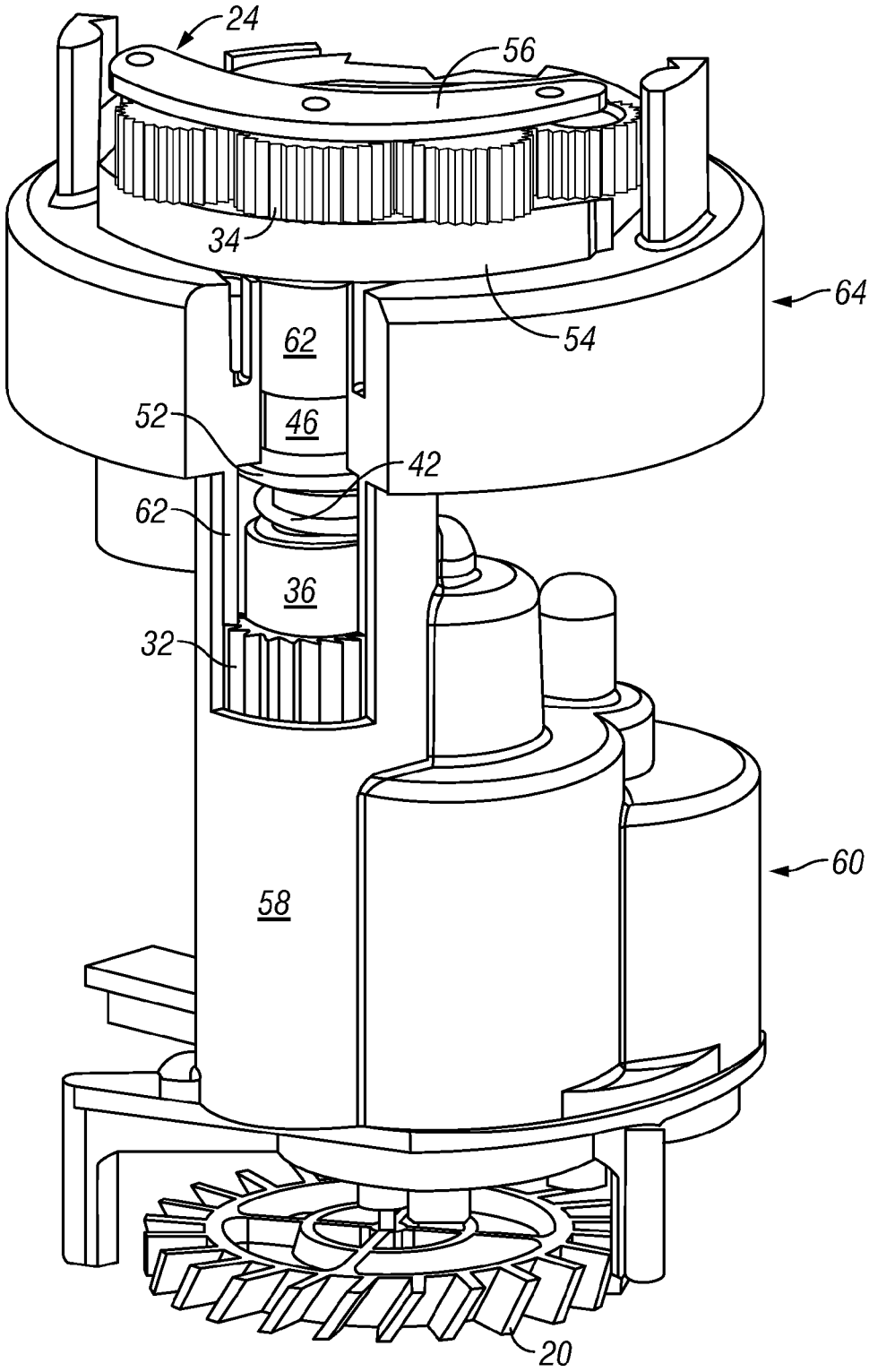
FIG. 3 is an enlarged assembled isometric view of the components illustrated in FIG. 2 with the gear box cut away.
Figure 4:
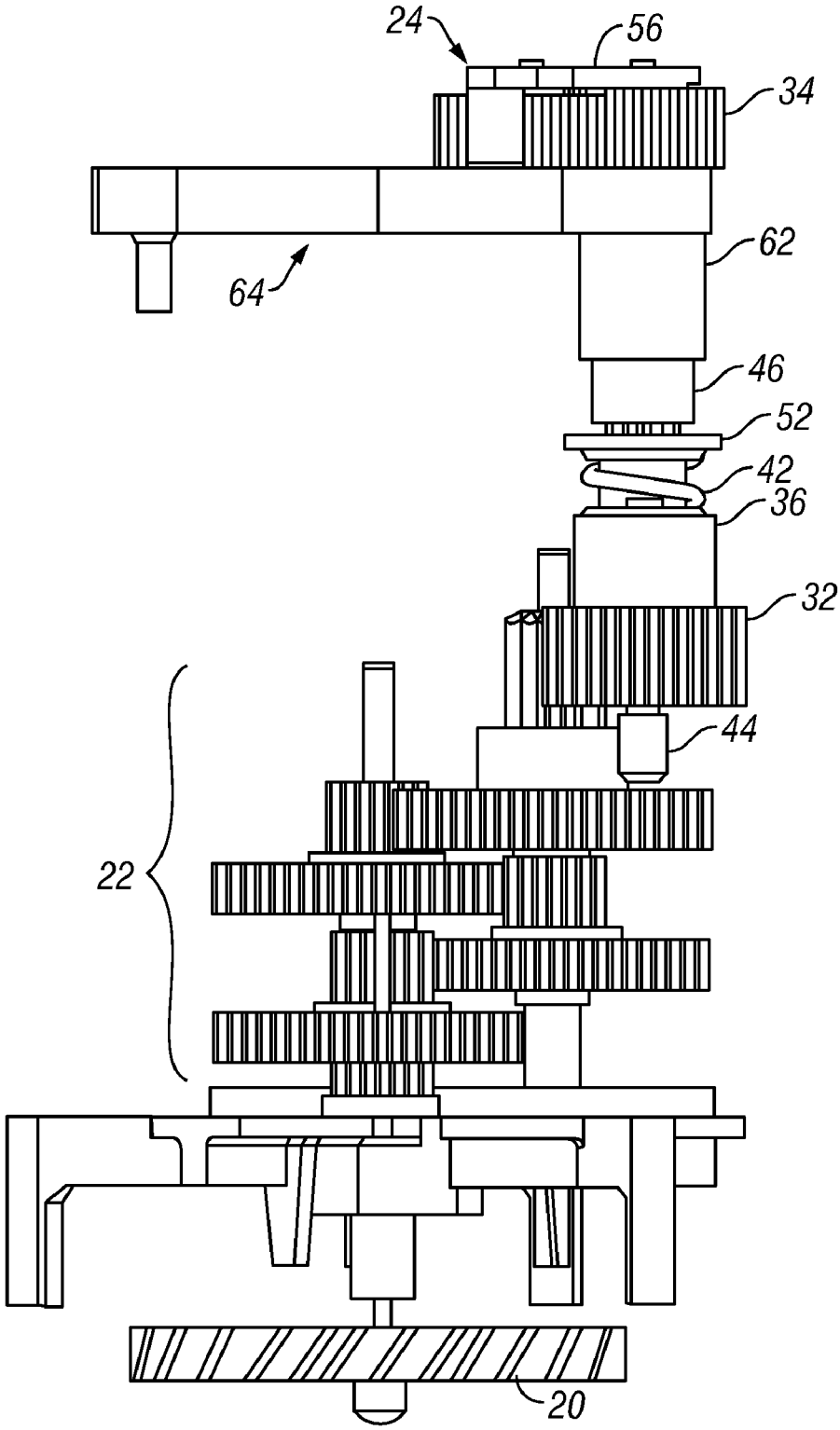
FIG. 4 is an enlarged assembled side elevation view of the components illustrated in FIG. 2 with the partition and gear box removed.
Figure 5:
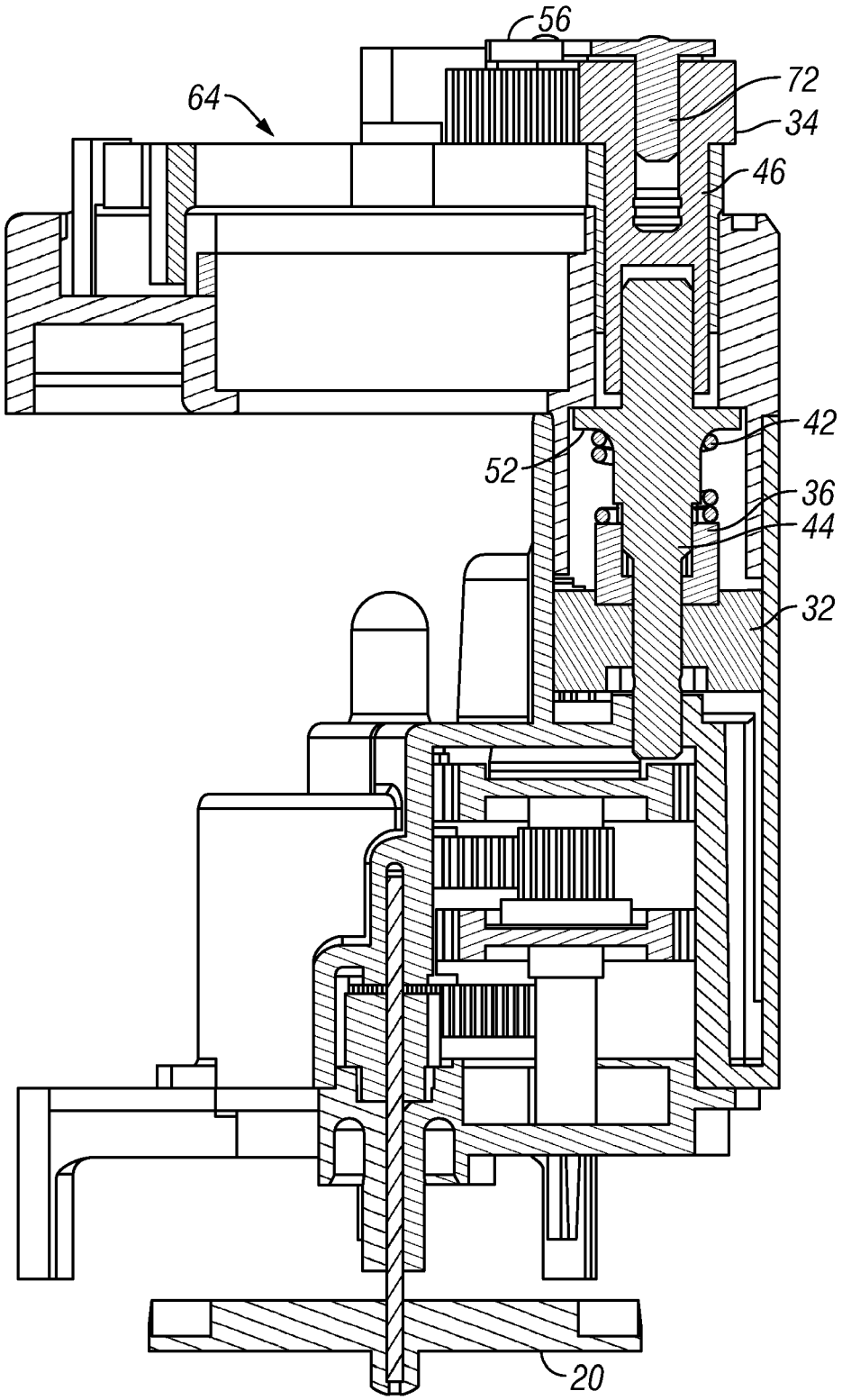
FIG. 5 is an enlarged assembled vertical cross-sectional view of the components illustrated in FIG. 2 showing the clutch member fully engaged with the final output gear of the reduction gear train to provide a positive drive connection.
Figure 7:
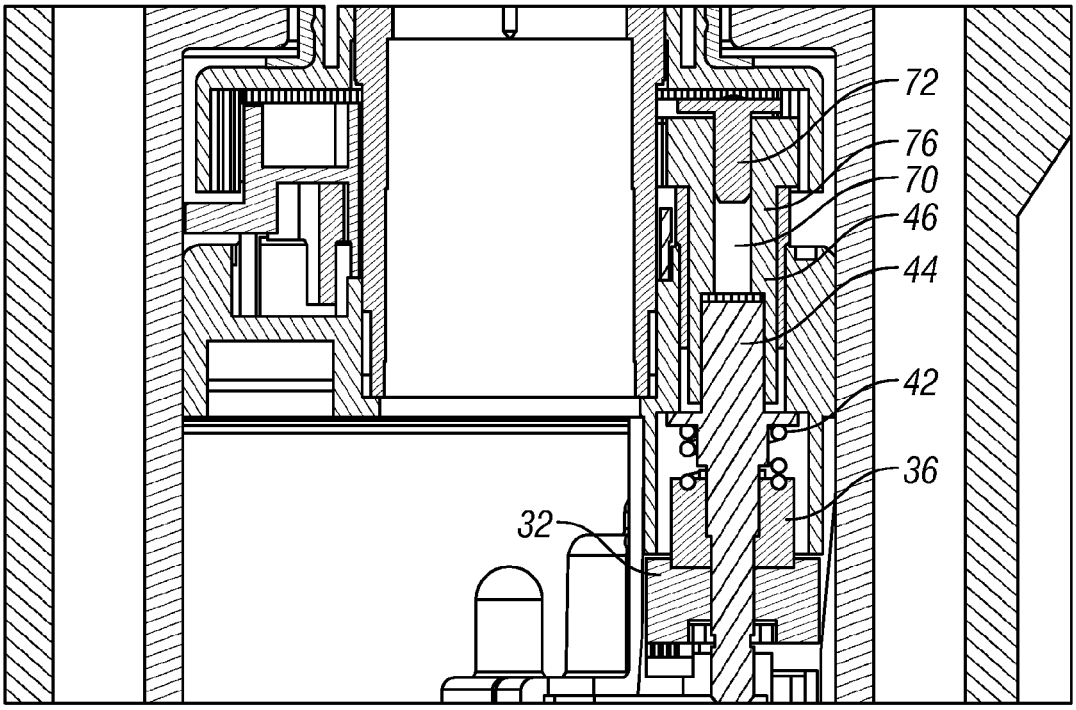
FIG. 7 is a greatly enlarged portion of FIG. 1 illustrating further details of the axially displacing slip-clutch.

Referring again to FIG. 2, the output gear 32, clutch member 36, spring 42 and lower output shaft 44 are received inside a tubular mounting sleeve 58 formed as part of a gear box 60. The clutch member 36, spring 42 and lower output shaft 44 are also received inside a tubular mounting sleeve 62 formed as part of a partition 64 as best seen in FIGS. 3-5. The tubular mounting sleeve 62 is inserted into the tubular mounting sleeve 58 as best seen in FIGS. 3 and 5. Dividing the clutch drive shaft that couples the clutch member 36 with the input gear 34 into the lower output shaft 44 and the upper output shaft 46 facilitates assembly of the slip-clutch 30. The upper end of the lower output shaft 44 is formed with a plurality of radially outwardly projecting teeth or ribs 66 (FIG. 12) which mate with corresponding teeth or ribs 68 (FIG. 11) formed in the lower portion of the central bore 70 (FIG. 7) of the upper output shaft 46 and this allows the two shafts 44 and 46 to be splined together. A cylindrical locator 72 extends into the upper end of the bore 70 to position the upper output shaft 46 relative to the upper frame 56.

The complementary pie-shaped projections 38 (FIG. 10) and recesses 40 (FIG. 8) of the clutch member 36 and output gear 32, respectively, extend radially and are circumferentially spaced. The projections 38 and recesses 40 have radially extending sloped surfaces 38*a* and 40*a* along their leading and trailing edges to facilitate slippage under an excessive load. Under normal load the projections 38 are fully seated in the recesses 40 and the sloped surfaces 38*a* and 40*a* overlap one another. In this state, the slip-clutch 30 holds under a normal level of rotational force generated internally by the turbine 20. The slip-clutch 30 releases under an excessive level of rotational force generated externally by a vandal twisting the nozzle turret 18. When this back driving occurs, the sloped surfaces 38*a* of the clutch member 36 slide upwardly over the sloped surfaces 40*a* output gear 32. Thereafter the horizontal undersides 38*b* (FIG. 10) of the clutch member 36 engage and slide over the horizontal upper sides 40*b* (FIG. 8) of the output gear 32. When the excessive level of rotational force terminates, the downward force of the spring 42 causes the sloped surfaces 38*a* of the clutch member 36 to slide downwardly over the sloped surfaces 40*a* output gear 32. This re-establishes a positive driving connection between the reduction gear train 22 and the reversing mechanism 24. The stainless steel coil spring 42 (FIGS. 2-5) maintains the correct load on the clutch member 36 over long periods of time. The coil spring 42 works in concert with the specific angles and shapes of the sloped surfaces 38*a* and 40*a* to provide accurate hold and slippage points.

Figure 6:
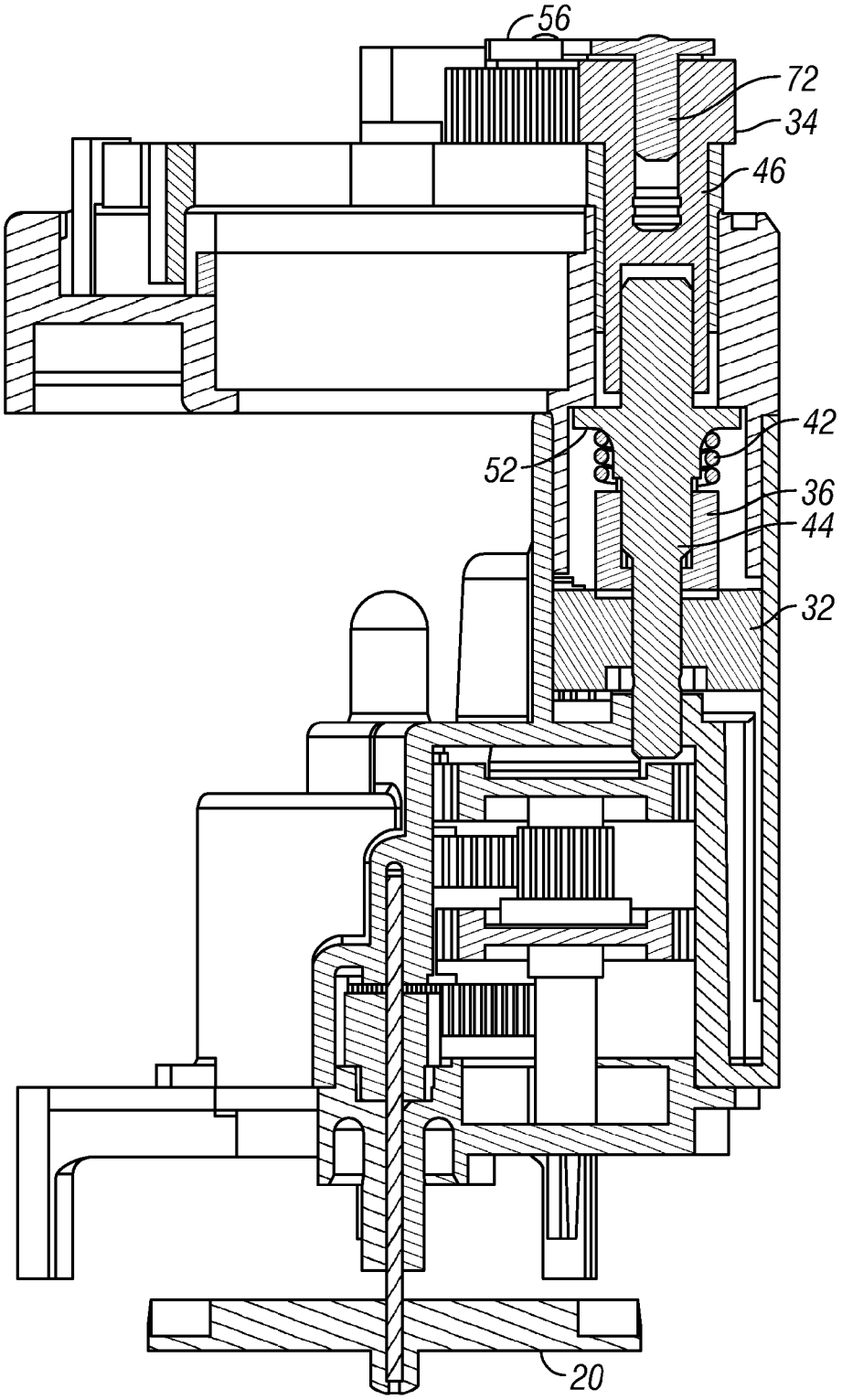
FIG. 6 is a view similar to FIG. 5 showing the clutch member vertically displaced upwardly and disengaged from a positive drive connection with the final output gear of the reduction gear train to allow slippage between the clutch member and the output gear as occurs when a vandal twists the nozzle turret of the sprinkler.

FIG. 5 illustrates the clutch member 36 fully engaged with the final output gear 32 of the reduction gear train 22 to provide a positive drive connection. FIG. 6 is a view similar to FIG. 5 illustrating the clutch member 36 vertically and axially displaced upwardly and disengaged from a positive drive connection with the final output gear 32 to allow slippage between the clutch member 36 and the output gear 32. This occurs when a vandal twists the nozzle turret 18 of the sprinkler 10. The axial displacement occurs along the vertical axis of rotation of the clutch member 36. Under an excessive load, such as that imparted by a vandal, the coil spring 42 is vertically compressed and allows the four pie-shaped projections 38 to ride upwardly out of the four pie-shaped recesses 40.

Thereafter the projections 38 slip continuously past the recesses 40 to permit relatively rotational movement between the output gear 32 and the output shafts 46 and 44 so long as an excessive load is applied backwardly through the reversing mechanism 24 in either direction. Once the vandal stops twisting the nozzle turret 18, the clutch member 36 vertically displaces downwardly under the force of the spring 42 to its normal position illustrated in FIG. 5. A positive drive connection is then re-established between the turbine 20 and the nozzle turret 18. The nozzle turret 18 can become locked against rotation due to mechanical failure or debris and the slip-clutch 30 will prevent damage to the reversing mechanism 24 and reduction gear train 22.

The slip-clutch 30 provides accurate control between the drive load and the breakaway load. It is relatively small and can be retrofitted into many existing rotor-type. The slip-clutch 30 is durable, reliable, and readily manufactured and assembled. The slip-clutch 30 is located lower down in the drive assembly than conventional clutches in rotor-type sprinklers. Many conventional rotor-type sprinklers associate the clutch with the relatively large hollow tubular shaft 26. The location of the slip-clutch 30 between the reduction gear train 22 and reversing mechanism 24 subjects the slip-clutch 30 to lower forces, allowing it to be smaller than clutches associated with the tubular drive shaft 26. Breakaway force levels can be more easily predetermined utilizing the slip-clutch 30 by selecting the correct coil spring 42 and/or projections 38 and recesses 40. The compressive strength of the stainless steel coil spring 42 can be varied by changing the diameter of the wire from which the spring 42 is formed, the number and spacing of its coils, and/or its diameter. The force desired to break the driving connection can be increased by increasing the angle of the sloped surfaces 38*a* and 40*a* relative to a horizontal plane i.e. a plane intersecting the rotational axis of the slip-clutch 30 in a perpendicular fashion. Conversely, the force desired to break the driving connection can be decreased by decreasing the angle of the sloped surfaces 38*a* and 40*a* relative to the aforementioned horizontal plane.

Figure 13:
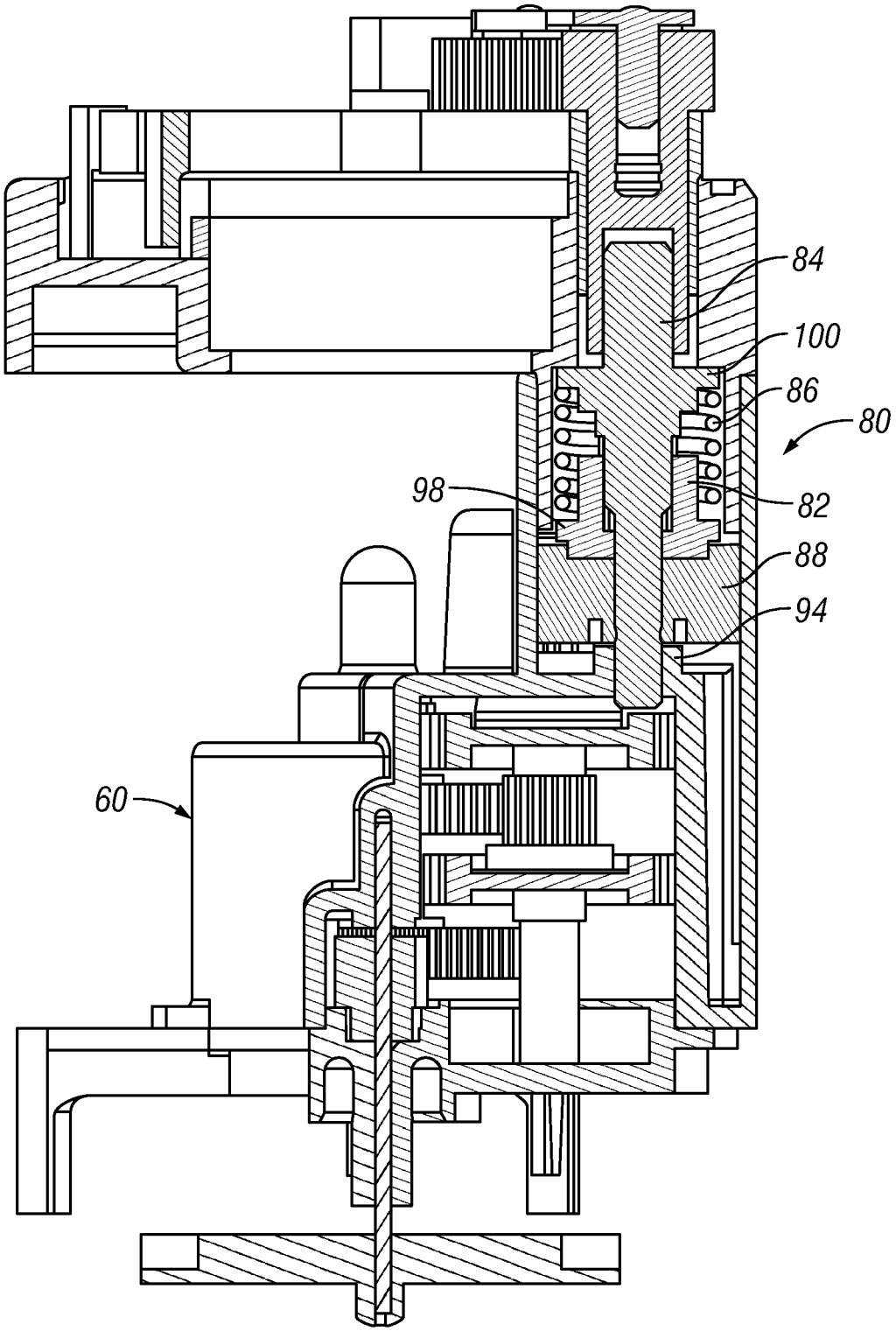
FIG. 13 is a view similar to FIG. 5 illustrating an alternate embodiment with a modified clutch member and lower output shaft that accommodate a larger spring.
Figure 14:
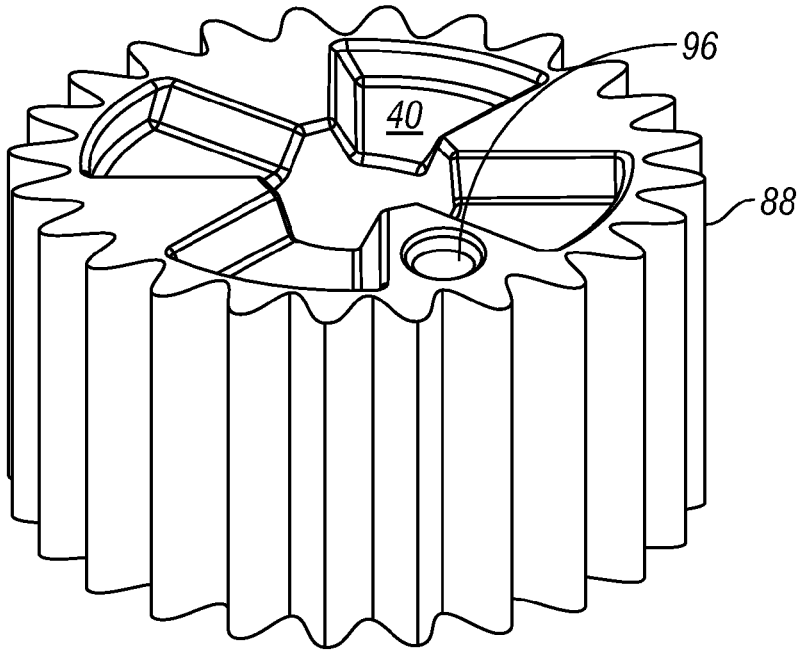
FIG. 14 is a greatly enlarged isometric view illustrating the top of the modified output gear of the alternate embodiment.
Figure 15:
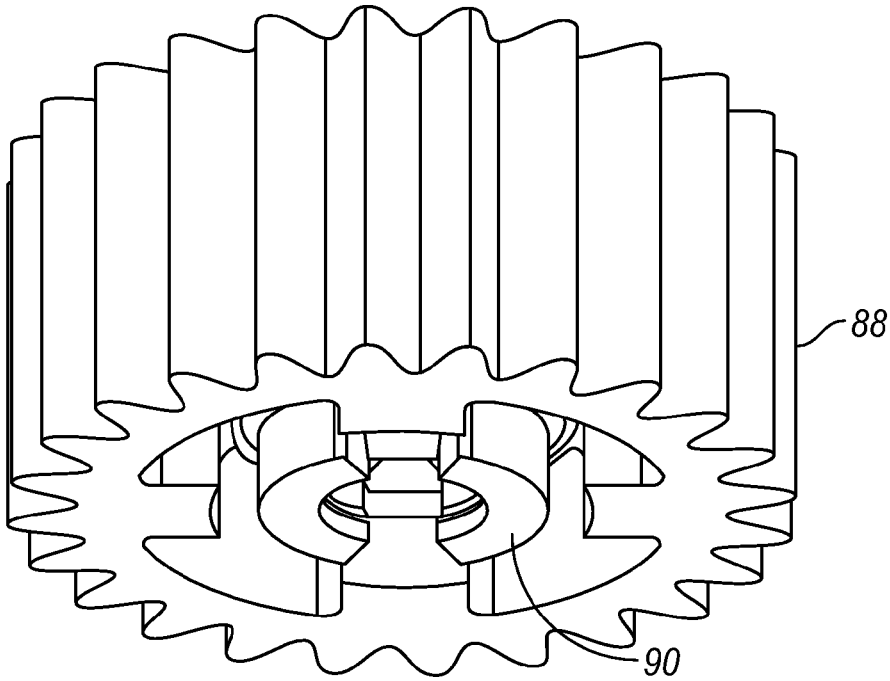
FIG. 15 is a greatly enlarged isometric view illustrating the bottom of the modified output gear of the alternate embodiment.
Figure 16:
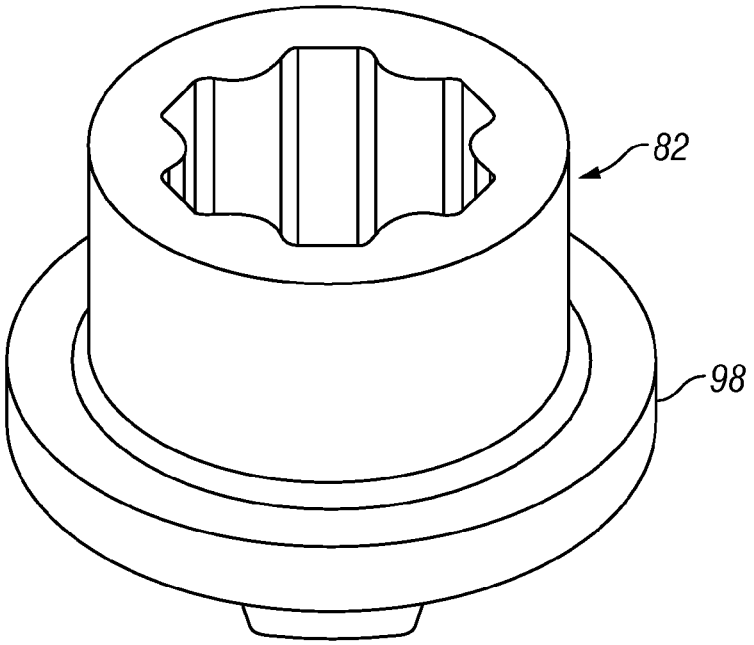
FIG. 16 is a greatly enlarged isometric view from the top of the modified clutch member of the alternate embodiment.
Figure 17:
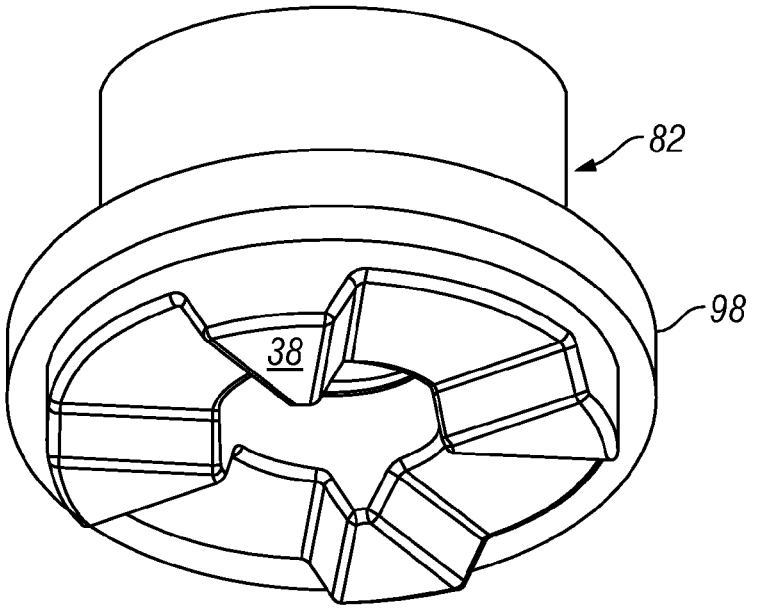
FIG. 17 is a greatly enlarged isometric view illustrating the underside of the modified clutch member of the alternate embodiment.
Figure 18:
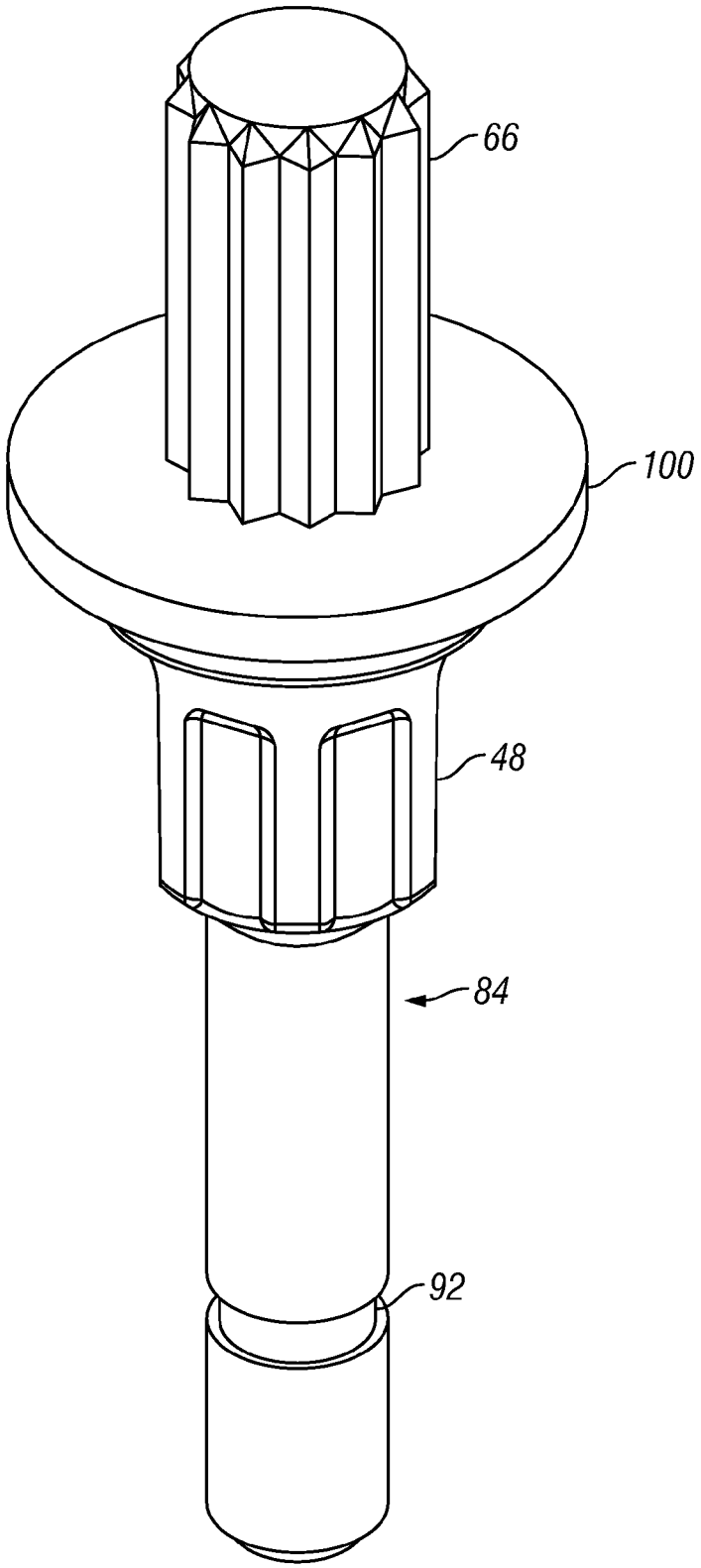
FIG. 18 is a greatly enlarged isometric view of the modified lower output shaft of the alternate embodiment of the axially displacing slip-clutch.

FIG. 13 illustrates an alternate embodiment 80 that is similar to the sprinkler 10 except that it incorporates a modified clutch member 82 and lower output shaft 84 that accommodate a larger coil spring 86. The coil spring 86 provides a more consistent load than the coil spring 42. The alternate embodiment 80 also incorporates a modified output gear 88 (FIGS. 13-15) that has a radially expandable collet 90 that snaps into an annular recess 92 (FIG. 18) in the modified lower output shaft 84 to fix the axial position of the output gear 88. This prevents the coil spring 86 from pushing the output gear 88 against the upper end of a shaft sleeve 94 (FIG. 13) of the gear box 60 which would otherwise produce unwanted friction and wear. The output gear 32 and lower output shaft 44 (FIG. 5) of the sprinkler 10 have a similar construction that axially fixes the position of the output gear 32. The upper side of the output gear 88 has a gate recess 96 (FIG. 14) so that when the output gear 88 is formed via injection molding, excess plastic from the gate of the tooling does not extend above the flat horizontal surface of the finished output gear 88. FIGS. 16 and 17 illustrate the enlarged flange 98 of the modified clutch member 82. FIG. 18 illustrates the enlarged flange 100 of the modified lower output shaft 84. The enlarged flanges 98 and 100 ensure that the enlarged coil spring 86 (FIG. 13) is retained and compressed between the modified clutch member 82 and the lower output shaft 84.

The sprinkler 10 (FIGS. 1-12) or the sprinkler with the modified slip-clutch 80 (FIGS. 13-18) can operate as full-circle, continuous three hundred and sixty degree rotation, rotor-type sprinklers. They may be constructed so that their nozzles 28 can optionally oscillate between pre-selected arc limits or rotated continuously in a uni-directional manner. See pending U.S. patent application Ser. Nos. 11/139,725 filed May 25, 2005 and 11/612,801 filed Dec. 19, 2006, of John D. Crooks, the entire disclosures of which are hereby incorporated by reference. The slip-clutch of the present invention can also be used in a rotor-type sprinkler that can only operate in full circle mode, i.e. the sprinkler has no reversing mechanism. When in a full circle mode, the nozzle turret 18 of either sprinkler may be rotated by a vandal in the same direction as the current direction of rotation of the nozzle 28. The load is taken off the drive assembly and the slip-clutches 30 and 80 do not slip. However, when the turret 18 is rotated by the vandal in the direction that is the reverse of the direction that is currently being driven by the turbine 20, the friction-clutches 30 and 80 slip under excessive load to prevent damage to the reversing mechanism 24 and reduction gear train 22.

While we have described several embodiments of our invention, modifications and adaptations thereof will occur to those skilled in the art. For example, the clutch member 36 need not directly engage the final output gear 32 of the reduction gear train 22, but could directly engage the input gear 34 of the reversing mechanism 24 or could be located at either the upper end of the lower output shaft 44, at the lower end of the upper output shaft 46, or anywhere between the final output gear 32 and the input gear 34. The size, number and shape of the complementary projections 38 and recesses 40 can be varied. Therefore, the protection afforded our invention should only be limited in accordance with the scope of the following claims.

We claim:

1. A sprinkler, comprising:

a riser;

an impeller mounted in the riser;

a nozzle rotatably mounted at an upper end of the riser;

a drive assembly including a reversing mechanism and a reduction gear train coupling the impeller and the nozzle; and a clutch in the drive assembly including a clutch member having an axis of rotation and located between an output gear of the reduction gear train and an input gear of the reversing mechanism, the clutch member providing a positive drive connection under a normal load and axially displacing and slipping under an excessive load, the clutch member directly engaging the output gear of the reduction gear train, the clutch member and the output gear having complementary projections and recesses, the clutch further including a drive shaft having a lower end coupled to the clutch member and an upper end coupled to the reversing mechanism, and the upper end of the drive shaft being coupled to the reversing mechanism of the drive assembly with a spur gear.

2. The sprinkler of claim 1 and further comprising a coil spring that urges the clutch member against the output gear.

3. The sprinkler of claim 2 wherein the coil spring is compressed between the clutch member and a shoulder of the drive shaft.

4. The sprinkler of claim 1 wherein the lower end of the drive shaft is splined to the clutch member.

5. The sprinkler of claim 1 wherein the complementary projections and recesses extend radially and are circumferentially spaced.

6. The sprinkler of claim 5 wherein the complementary projections and recesses have sloped surfaces to facilitate slippage under the excessive load.

7. A sprinkler, comprising:

a riser;

an impeller mounted in the riser;

a nozzle rotatably mounted at an upper end of the riser;

a drive assembly including a reduction gear train and a reversing mechanism coupling the impeller and the nozzle; and a clutch in the drive assembly including a clutch member having an axis of rotation, the clutch member engaging an output gear of the reduction gear train and providing a positive drive connection under a normal load and axially displacing and slipping relative to the output gear under an excessive load, a coil spring that urges the clutch member against the output gear, the clutch further including a drive shaft having a lower end coupled to the clutch member and an upper end coupled to the reversing mechanism, and wherein the coil spring is compressed between the clutch member and a shoulder of the drive shaft.

8. The sprinkler of claim 7 wherein the lower end of the drive shaft is splined to the clutch member.

9. The sprinkler of claim 7 wherein the upper end of the drive shaft is coupled to the reversing mechanism of the drive assembly with a spur gear.

10. The sprinkler of claim 7 wherein the output gear and clutch member have complementary projections and recesses.

11. The sprinkler of claim 10 wherein the projections and recesses extend radially, are circumferentially spaced, and have sloped surfaces to facilitate slippage under the excessive load.

12. A sprinkler, comprising:

a riser;

an impeller mounted in the riser;

a nozzle rotatably mounted at an upper end of the riser;

a drive assembly including a reduction gear train and a reversing mechanism coupling the impeller and the nozzle; and a clutch in the drive assembly including a clutch member having an axis of rotation and engaging an output gear of the reduction gear train, a drive shaft having a lower end coupled to the clutch member and an upper end coupled to the reversing mechanism, a coil spring compressed between the clutch member and a shoulder of the drive shaft that urges the clutch member against the output gear, and the output gear and clutch member have complementary projections and recesses so that the clutch member provides a positive drive connection under a normal load and axially displaces and slips relative to the output gear under an excessive load.

* * * * *